US006922189B2

(12) United States Patent
Fujiyoshi

(10) Patent No.: US 6,922,189 B2
(45) Date of Patent: Jul. 26, 2005

(54) IMAGE-SIGNAL DRIVING CIRCUIT ELIMINATING THE NEED TO CHANGE ORDER OF INPUTTING IMAGE DATA TO SOURCE DRIVER

(75) Inventor: Tatsumi Fujiyoshi, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 286 days.

(21) Appl. No.: 10/188,185

(22) Filed: Jul. 1, 2002

(65) Prior Publication Data

US 2003/0006978 A1 Jan. 9, 2003

(30) Foreign Application Priority Data

Jul. 9, 2001 (JP) ..... 2001-208161

(51) Int. Cl.[7] ..... G09G 5/00
(52) U.S. Cl. ..... 345/204
(58) Field of Search ..... 345/204, 55–58, 345/74–80, 65, 87–97; 348/280, 322, 333; 445/6; 313/495; 315/169.3

(56) References Cited

U.S. PATENT DOCUMENTS 5,724,061 A 3/1998 Kanbara ..... 345/100
5,734,451 A * 3/1998 Yanagawa et al. ..... 349/43
5,737,017 A * 4/1998 Udagawa et al. ..... 348/280
5,844,531 A * 12/1998 Betsui ..... 345/74.1
6,144,350 A * 11/2000 Fujii et al. ..... 345/74.1
6,621,488 B1 * 9/2003 Takeuchi et al. ..... 345/204
6,642,913 B1 * 11/2003 Kimura et al. ..... 345/84
6,707,437 B1 * 3/2004 Kuno et al. ..... 345/74.1
6,765,616 B1 * 7/2004 Nakano et al. ..... 348/322
2002/0154101 A1 * 10/2002 Abe et al. ..... 345/204
2002/0171608 A1 * 11/2002 Kanai et al. ..... 345/55
2004/0046882 A1 * 3/2004 Nakano et al. ..... 348/294
2004/0046884 A1 * 3/2004 Nakano et al. ..... 348/333.01
2004/0070331 A1 * 4/2004 Kuno et al. ..... 313/495
2004/0164684 A1 * 8/2004 Inukai et al. ..... 315/169.3
2004/0246210 A1 * 12/2004 Azami ..... 345/76

* cited by examiner

*Primary Examiner*—Bipin Shalwala
*Assistant Examiner*—Prabodh Dharia
(74) *Attorney, Agent, or Firm*—Beyer Weaver & Thomas LLP

(57) ABSTRACT

An image-signal driving circuit inputs serial sequences of image data DA, DB, and DC for key or primary colors, converts the image data into parallel data for displaying one line on a display, and supplies the parallel data to the display. The image-signal driving circuit comprises a register that inputs sequences of image data for the number of primary colors, stores the image data in order, and outputs the image data as parallel data; a latch that latches the sequences of image data for the number of primary colors output from the register as the parallel data; and a selector that selects one sequence of image data from the sequences of image data for the number of primary colors latched by the latch in predetermined order, and supplies the image data to the display.

21 Claims, 12 Drawing Sheets

| SELECT SIGNAL | | | OUT |
|---|---|---|---|
| SEL1 | SEL2 | SEL3 | |
| 0 | 0 | 0 | 0 |
| 1 | × | × | DA |
| 0 | 1 | × | DB |
| 0 | 0 | 1 | DC |

× IS "DON'T CARE"

IMAGE-SIGNAL DRIVING CIRCUIT ELIMINATING THE NEED TO CHANGE ORDER OF INPUTTING IMAGE DATA TO SOURCE DRIVER

BACKGROUND OF THE INVENTION

1. Field of the Invention

The present invention relates to a display device for displaying a color by using a plurality of primary or key colors including red (R), green (G), and blue (B) in combination, and particularly relates to an image-signal driving circuit for supplying image data to a display of the display device.

2. Description of the Related Art

Display devices capable of color display by using a liquid-crystal display, a light source, and a color filter in combination are known.

FIG. 12 shows the arrangement of the color filters provided in subpixels or dots 104 on a display 101 of a conventional display device. The subpixels 104, which are also sometimes described as subpixels, each comprise one color filter. The display 101 typically displays colors in display units called pixels. A pixel typically consists of red, blue, and green subpixels, side by side, which together combine to form a color for the pixel of the display. The subpixels take their color from the color of the filter for the subpixel of the display. Hence, a pixel forming colors from red, blue, and green subpixels will typically be part of a display configured with red (R), green (G), and blue (B) filters in the respective subpixel locations making up the display pixel.

In a horizontal direction of one form of display(i.e., along scan lines G1, G2, G3, and so on), the three kinds of color filters are disposed in an alternating order along the row, as for example R, G, B, R, G, B, and so forth. In a vertical direction (i.e., along signal lines S1, S2, S3, and so on), each column has a single kind of color filter. For example, an entire column of R-color filters are provided in subpixels between the signal lines S1 and S2. Hereinafter, the above-described arrangement of the color filters will be referred to as the vertical stripe configuration.

Hereinafter, the display unit for displaying one of the primary colors is referred to as a subpixel 104. Further, the display unit for displaying a color by using three primary colors including R, G, and B in combination, that is, three subpixels 104 with three kinds of color filters (such as disposed along the scan line for the vertical stripe configuration), is referred to as a pixel 108.

In a vertical stripe configuration, when the number of pixels disposed in a horizontal direction (i.e., along the scan lines) is n, the number of subpixels is three times the number of pixels, that is, 3n. VGA systems, for example, specify a display of 640×480 pixels. Since the number of pixels in the horizontal direction is n=640, the number of subpixels is 3n=3×640=1920. Accordingly, the number of signal lines is 3n=1920. The number of pixels in the vertical direction (i.e., along the signal lines) in VGA systems (using the vertical stripe configuration) is the same as the number of the subpixels, that is, 480. Consequently, the number of scan lines is 480.

FIG. 13 is a block diagram showing the configuration of a source driver Sd100 of the conventional display device. Typically, a subpixel in a display is addressed by applying voltage to a gate line that switches on the subpixel and allows a voltage charge from the source driver to be applied (i.e., along the signal lines from the source driver) to the subpixel. Source driver Sd100 comprises a shift register 9; a sampling register 10; a line latch 11, a level shifter 113, a D/A converter 114, and an amplifier 115. The source driver Sd receives image data DA, DB, and DC, which are three sequences of digital data, and outputs analog data to signal lines (source wiring) S1, S2, S3, and so forth on the display 101. That is, image data R, G, and B for each pixel are received respectively as image data DA, DB, and DC.

The source driver receives the image data for each subpixel in a digital format. For example, the image data DA, DB, and DC may correspond respectively to the intensities of the red, green, and blue subpixels. As a further example, if DA is an 8-bit signal corresponding to the red subpixel, 256 different red color intensities may potentially be represented by this digital signal.

As noted above, for each full color pixel, three distinct subpixels are employed. With a combination of red, green, and blue subpixels of various intensities, for example, a pixel may be made to appear to the human eye to be any of a variety of different colors. Thus, the number of colors that can be made by mixing red, green, and blue subpixels depends on the distinct grayscale intensities that can be achieved by the pixels in the display. The image data DA, DB, and DC are typically received by the source driver of the display device in parallel but are sent serially several bits at a time.

The source driver Sd controls operation of its shift register 9 to store image data for one line in the sampling register 10. The shift register 9 starts operating in response to a start pulse received concurrently with a clock signal, and outputs "1" (i.e., an active signal) sequentially to each stage of the sampling register 10. Next, each stage of the sampling register 10 stores the image data DA, DB, and DC in response to the active signal received at each stage.

The line latch 11 latches (stores) image data for one line at a time in accordance with a load signal after the sampling register 10 has stored the image data for one line.

The level shifter 113 receives 3n image data output from the line latch 11 and outputs the image data after converting the logic level thereof. The D/A converter 114 converts the image data that is a digital signal to an analog signal. At this time, the D/A converter 114 receives a gradation voltage and performs the conversion on the basis of the received gradation voltage. The amplifier 115 amplifies the analog signal (mainly for amplifying the voltage), transmits the amplified analog signal to the signal line, and drives the display 101.

FIG. 14 is a block diagram showing the configuration of the sampling register 10. The sampling register 10 comprises a buffer 16 and stages 10-1, 10-2, 10-3, 10-4, and so forth. The image data DA, DB, and DC received by the sampling register 10 is transmitted to each of the stages 10-1, 10-2, 10-3, 10-4, and so forth via the buffer 16. When the shift register 9 transmits a "1" to one of the stages 10-1, 10-2, 10-3, 10-4, and so forth, the stage stores the image data DA, DB, and DC received from the buffer 16, and transmits the stored image data DA, DB, and DC to the line latch 11.

The horizontal stripe configuration is an alternative display configuration and aligns three different kinds of color subpixels vertically by using known source drivers. Since pixels are addressed or activated on a display one line at a time, in order to drive a display using a horizontal stripe configuration, the order of inputting image data to the source driver must be different for horizontal stripe configurations as compared to the vertical stripe configurations. Thus, in order to convert the order of the image data (e.g. Da, DB, and DC) received by the conventional source and gate drivers in the conventional display device to an acceptable sequence for driving a display using a horizontal stripe configuration, the size of an external circuit for supplying image data to the source driver becomes large. Further, this external circuit cannot be used for displays having a vertical stripe configuration.

SUMMARY OF THE INVENTION

To this end, the present invention provides an image-signal driving circuit and a display device comprising the image-signal driving circuit capable of taking the received image data without modification and driving displays having either horizontal or vertical stripe configurations. Accordingly, an external circuit for supplying image data to the source driver is reduced in size and the image-signal driving circuit can also be used for both the vertical stripe and horizontal stripe configurations.

According to a first aspect of the present invention, there is provided an image-signal driving circuit. The image-signal driving circuit inputs sequences of serial image data for a number of primary or key colors, converts the sequences of serial image data into parallel data for displaying one line on a display, and supplies the parallel data to the display. The image-signal driving circuit comprises a register that inputs the sequences of image data for the number of primary colors, stores the image data in order, and outputs the image data as parallel data. The image-signal driving circuit further comprises a latch that latches the sequences of image data for the number of primary colors output from the register, and a selector that selects one sequence from the sequences of image data for the number of primary colors latched by the latch in predetermined order, and supplies the selected image data to the display.

According to the above-described configuration, the configuration of image data supplied to the image-signal driving circuit is the same as that of image data used for driving a display using the vertical stripe method.

Preferably, in the image-signal driving circuit, the selector selects one sequence from the sequences of image data in an order corresponding to the arrangement of the primary colors on the display, and supplies the selected sequence of image data to the display. In this case, triple-speed scanning (non-interlaced scanning) and thinning scanning are achieved. Accordingly, it becomes easy to adapt the driver to a display having the horizontal stripe configuration. Moreover, the number of signal lines is fewer than in the case where the vertical stripe method is used. Further, the cost and the power consumption can be reduced.

According to a second aspect of the invention, there is provided a display device comprising the image-signal driving circuit.

Preferably, in the display device, the selector in the image-signal driving circuit selects one sequence from the sequences of image data in an order corresponding to the arrangement of the primary colors on the display, and supplies the selected sequence of image data to the display.

According to the present invention, there is no need to. change the order of inputting an image signal to the image-signal driving circuit. Therefore, an external circuit for supplying the image signal to the source driver is small in size, and the external circuit can be used for both the horizontal and vertical stripe configurations.

DESCRIPTION OF THE PREFERRED EMBODIMENTS

Figure 1:
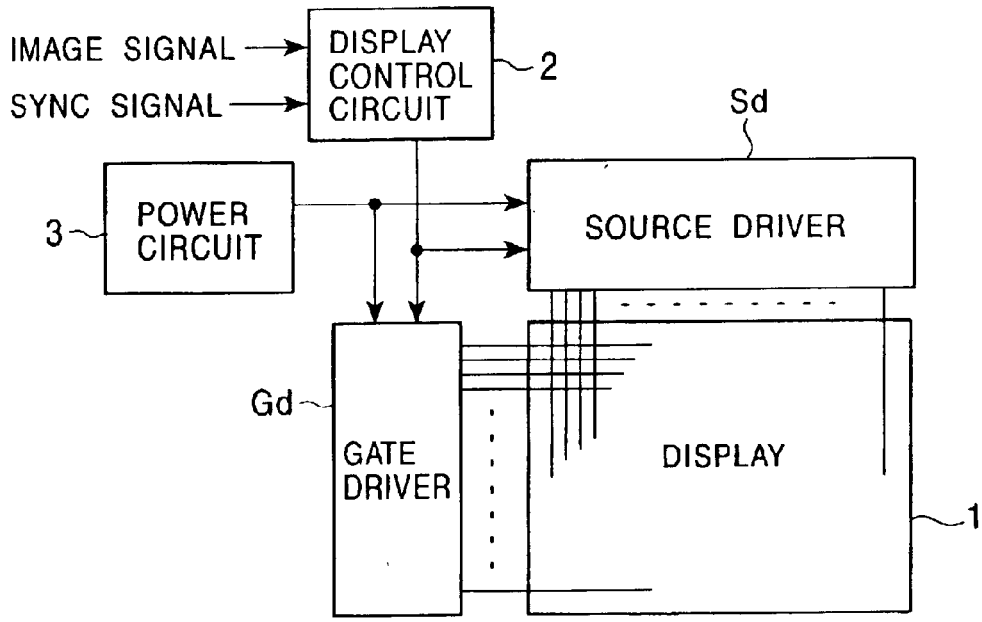
FIG. 1 is a block diagram of a display device according to a first embodiment of the present invention.

FIG. 1 is a block diagram illustrating the configuration of a display device according to a first embodiment of the present invention. This display device comprises a display 1 for displaying an image; a source driver Sd and a gate driver Gd for driving the display 1; a display control circuit (an external circuit) 2 for supplying image data or the like to the source driver Sd and the gate driver Gd; and a power circuit 3 for supplying power to the source driver Sd and the gate driver Gd.

The display 1 is a liquid-crystal display panel having a liquid crystal filled between two transparent substrates. The source driver Sd is disposed at the top edge of the display 1, and the gate driver is disposed at the left edge thereof.

Figure 2:
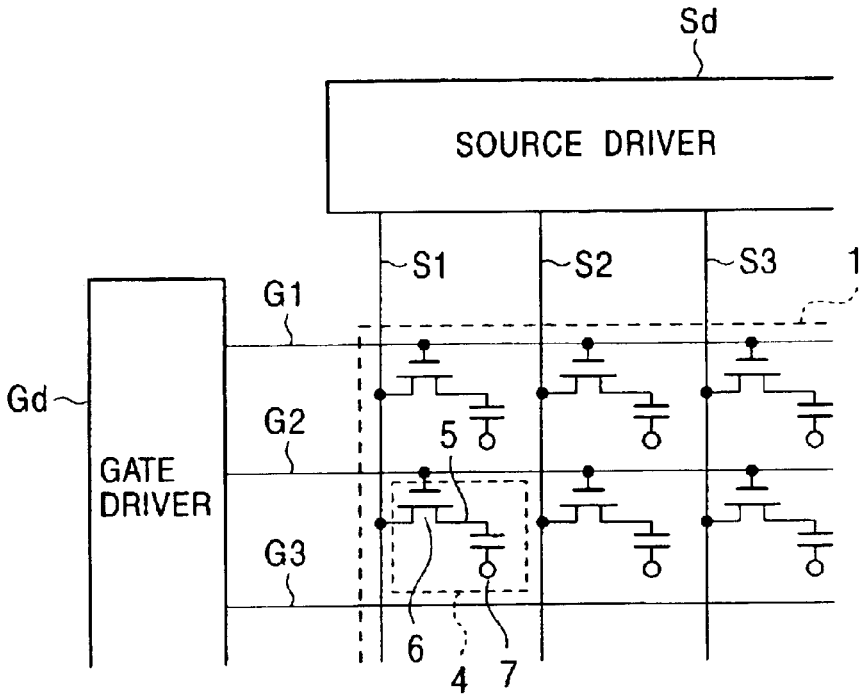
FIG. 2 is an enlarged view of a display illustrated in FIG. 1.

FIG. 2 is an enlarged view of the display 1 having a plurality of areas divided into grids by a plurality of vertical signal lines (source wiring) S1, S2, S3, and so forth, which are connected to the source driver, and by a plurality of horizontal scan lines (gate wiring) G1, G2, G3, and so forth, which are connected to the gate driver Gd.

In each of the divided areas, a subpixel 4 having a pixel electrode 5, a thin film transistor (TFT) 6, a common electrode 7, and a color filter having one color (not shown) is formed. The pixel electrode 5 and the TFT 6 are formed on one of the transparent substrates, and the common electrode 7 and the color filter are formed on the other transparent substrate.

Figure 3:
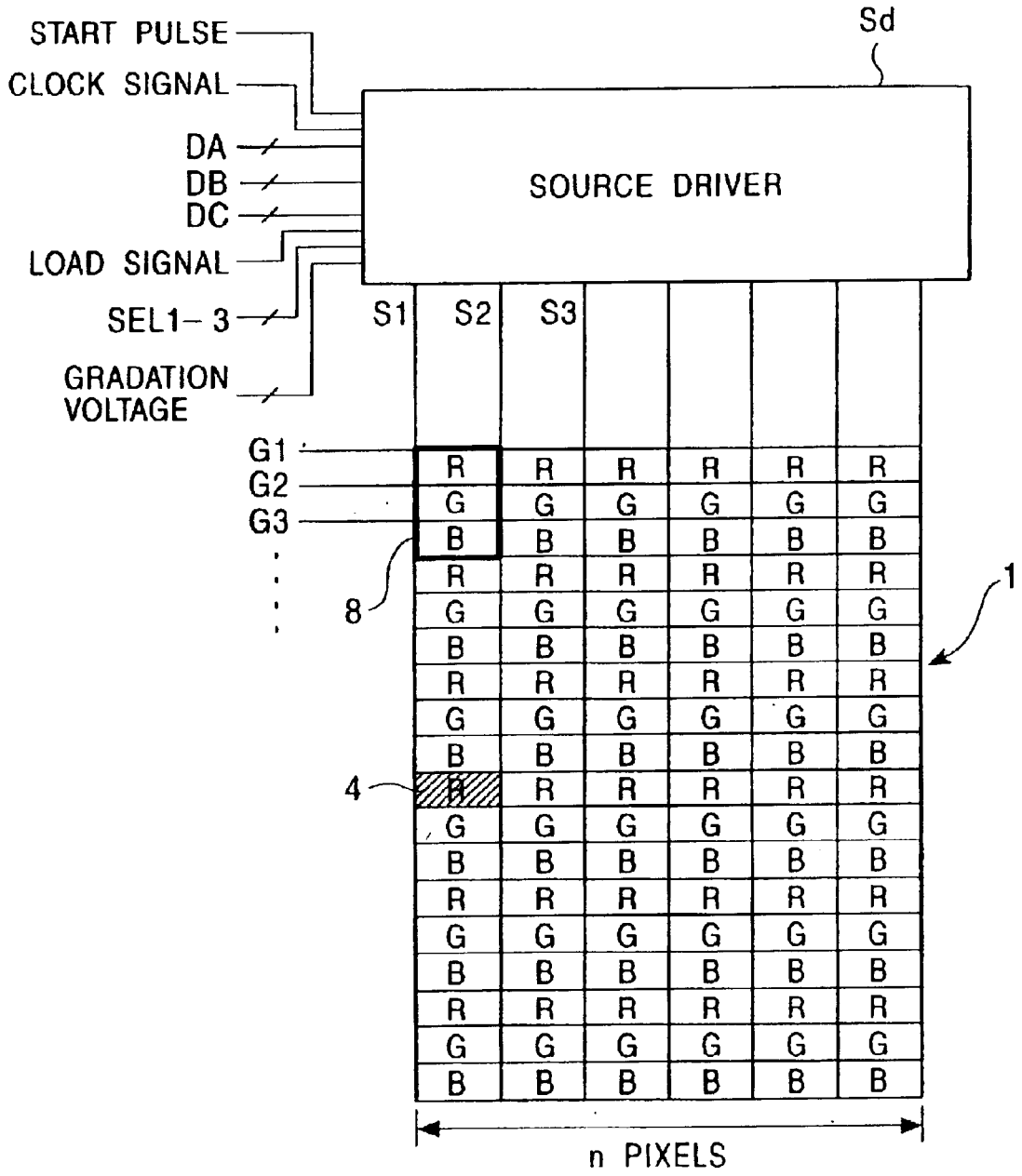
FIG. 3 shows the position of color filters each provided in each of subpixels.

FIG. 3 shows the arrangement of the color filters provided by each of the subpixels 4 in a display having a horizontal stripe configuration. The color filters are red (R), green (G), or blue (B). These three colors are called primary colors. Along the scan lines (i.e., the horizontal lines), the filters of the same primary color are disposed. For example, the R-color filters are disposed in the subpixels between a scan line G1 and a scan line G2. However, along the signal lines (i.e., the vertical lines), three kinds of primary color filters are disposed in an alternating order, as, for example, R, G, B, R, G, B, and so forth.

Hereinafter, the display unit for displaying one of the primary colors is referred to as a subpixel 4. Further, the display unit for displaying a color using all three primary colors in combination, that is, three subpixels 4 with three kinds of color filters (disposed along the signal line for the horizontal stripe configuration) is referred to as a pixel 8.

As a result, the number of subpixels horizontally disposed along the scan lines is indicated by n. As noted above, a VGA system displays 640×480 pixels. Thus, for example, 640 pixels 8 or subpixels 4 are horizontally displayed along the scan line, that is, n=640. Accordingly, the number of signal lines is also shown as n=640. Further, in the VGA system and using the horizontal stripe configuration, since 480 pixels 8 are vertically displayed along the signal line, the number of subpixels 4 is three times the number of pixels 8, that is, 480×3=1440. Accordingly, the number of scan lines required to address these subpixels in a display having a horizontal stripe configuration is 1440.

Generally, the source driver Sd costs about twice as much as the gate driver Gd for a given size. Therefore, the cost of the display device can be greatly reduced by reducing the number of signal lines connected to the expensive source driver Sd. With the arrangements as described in the present invention, the number of signal lines may be reduced without reducing the number of pixels 8 or subpixels 4 displayed by the display device.

Moreover, the source driver Sd consumes more power than the gate driver Gd, since the source driver Sd controls the gradation of the subpixels 4 (i.e., the grayscale levels of the subpixels) wherein the gate driver Gd only controls ON/OFF signals for the subpixels 4. Hence, by decreasing the number of signal lines connected to the source driver Sd, the power consumption of the display device can also be reduced.

In accordance with other embodiments of the present invention, the arrangement of the three kinds of color filters may be different from the above-described case.

Figure 4:
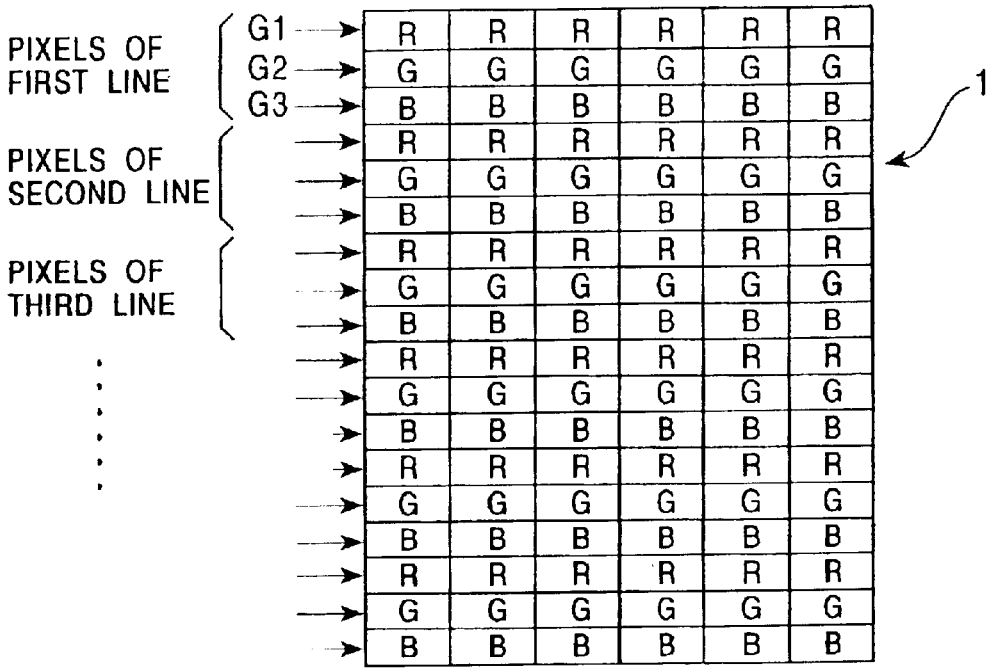
FIG. 4 shows the order in which the subpixels are displayed on the display when triple-speed scanning (non-interlaced scanning) is performed in accordance with one embodiment of the present invention.

FIG. 4 shows the sequence in which the subpixels are displayed-on the display 1 when triple-speed scanning (non-interlaced scanning) is performed. The scan lines are scanned in the order of G1, G2, G3, and so on. The scan lines are scanned three times faster than in the case where the vertical stripe method is used. As an example, to display 480 lines of full color pixels, three lines of subpixels (red, green, and blue) must be displayed for each of the 480 lines.

Figure 5:
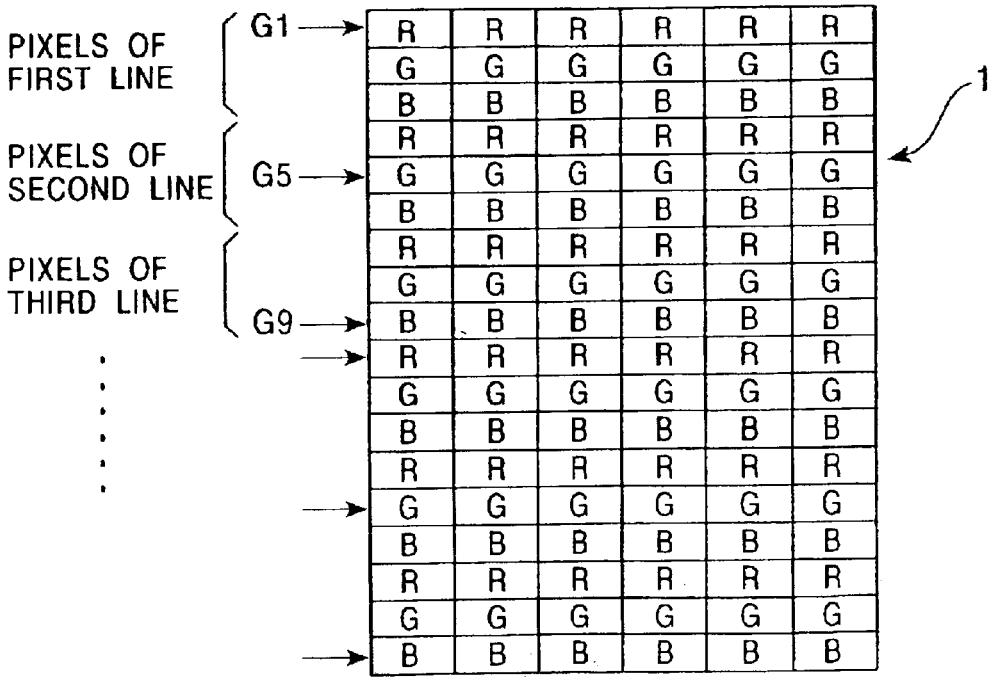
FIG. 5 shows the order in which the subpixels are displayed on the display when thinning scanning (interlaced scanning) is performed in accordance with one embodiment of the present invention.

FIG. 5 shows the order in which the subpixels are displayed on the display 1 when thinning scanning (interlaced scanning) is performed. The scan lines are scanned in the order of G1, G5, G9, and so on, and the subpixels on the display 1 are thinned out and displayed in the order of the R of the first line pixel, the G of the second line pixel, the B of the third line pixel, and so forth.

When the scan lines G1, G5, G9, and so on are scanned and the R of the first line pixel, the G of the second line pixel, the B of the third line pixel, and so on are displayed on one screen, the scan lines G2, G6, G7, and so on are scanned and the G of the first line pixel, the B of the second line pixel, the R of the third line pixel, and so forth are displayed on the next screen. On the following screen, the scan lines G3, G4, G8, and so forth are scanned and the B of the first line pixel, the R of the second line pixel, the G of the third line pixel, and so on are displayed.

Since the above-described thinning scanning allows for lowering the driving frequency of the source driver Sd, the power consumption can be further reduced. When performing thinning scanning on a display of a VGA panel by using the horizontal stripe method, the consumption power is 40 percent or less than that of the case where the conventional vertical stripe method is used.

Figure 6:
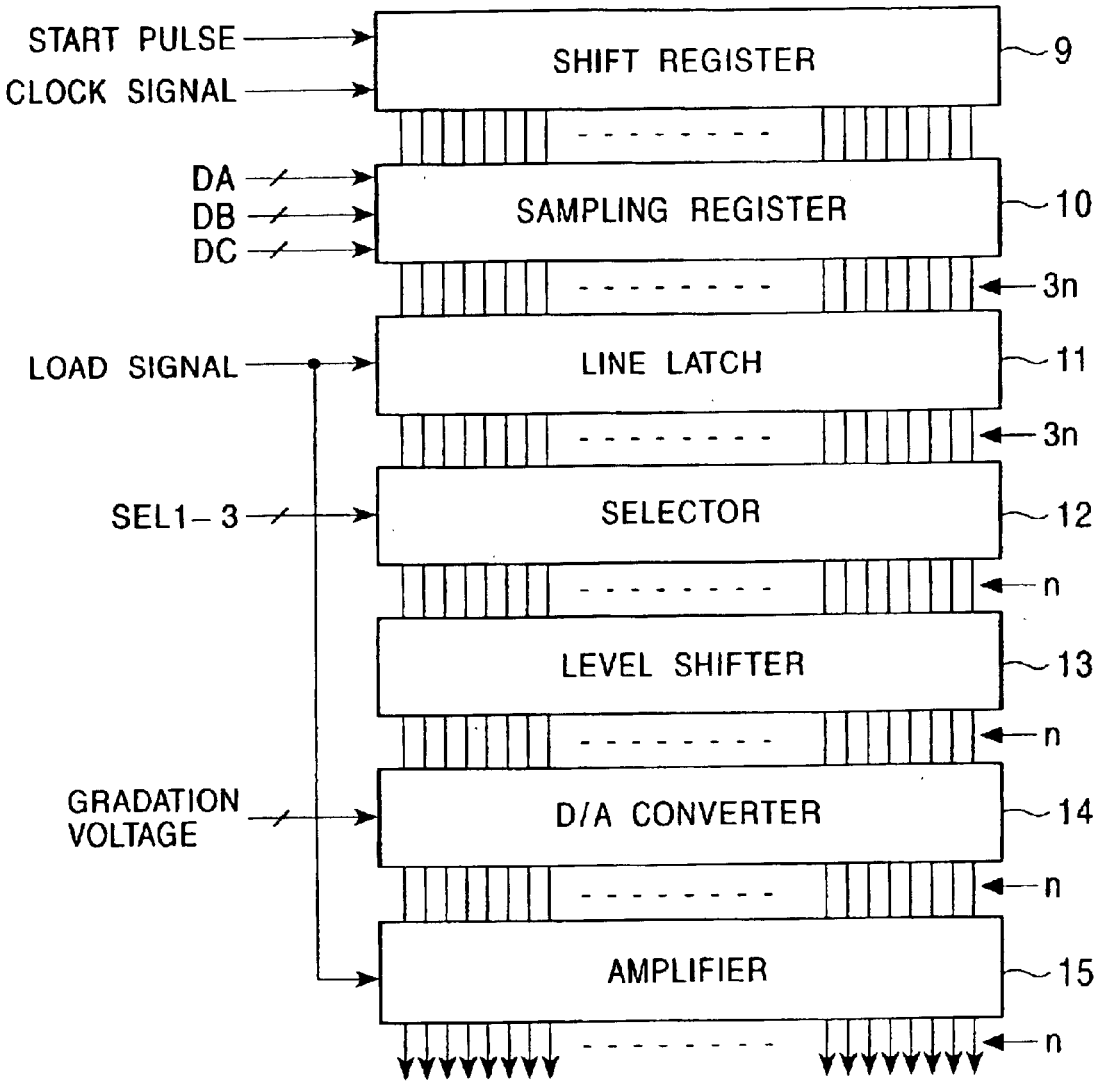
FIG. 6 shows the configuration of a source driver in accordance with one embodiment of the present invention.

FIG. 6 shows the configuration of the source driver Sd comprising a shift register 9; a sampling register 10; a line latch 11, a selector 12, a level shifter 13, a D/A converter 14, and an amplifier 15. The source driver receives image data DA, DB, and DC, which are three sequences of digital data, and outputs analog data to each signal line (each source wiring). That is, image data R, G, and B are received respectively as image data DA, DB, and DC.

The digital image data DA, DB, and DC are received in parallel but are sent serially several bits at a time. The size (bus widths) of the digital image signals, i.e. Da, DB, and DC defines the grayscale levels available to represent the intensities of the R,G, and B image data. The source driver Sd processes the serial data by commencing operation of the shift register 9 and storing image data for one line in the sampling register 10.

That is, the shift register 9 starts operating upon receipt of a start pulse simultaneous with a clock signal, and outputs "1" sequentially to each stage of the sampling register 10 in order. Next, each stage of the sampling register 10 stores the image data DA, DB, and DC.

The line latch 11 latches (stores) image data for one line at a time in accordance with a load signal received after the sampling register 10 has stored the image data for one line.

The selector 12 selects and outputs the selected data according to the configuration of the display and the scanning method chosen. For example, the output of the data may depend upon the display configuration of horizontal stripe versus vertical stripe. Further, the output sequence is dependent upon the scanning method selected, such as, for example, non-interlaced scanning versus interlaced scanning. The selector 12 selects one sequence from three sequences of image data DA, DB, and DC according to select signals SEL1, SEL2, and SEL3, and outputs the selected data. Accordingly, for a horizontal stripe configuration, when the number of subpixels aligned in the horizontal direction is n, the selector 12 receives at an input 3n image data and outputs n image data.

The level shifter 13 receives n image data output from the selector 12 and outputs the image data after converting the logic level thereof. The D/A converter 14 converts the image data that is a digital signal to an analog signal. At this time, the D/A converter 14 receives gradation voltage signals and performs conversion on the basis of the gradation voltage. The amplifier 15 amplifies the analog signal (mainly for amplifying the voltage), transmits the amplified analog signal to the signal line, and drives the display 1.

Figure 7:
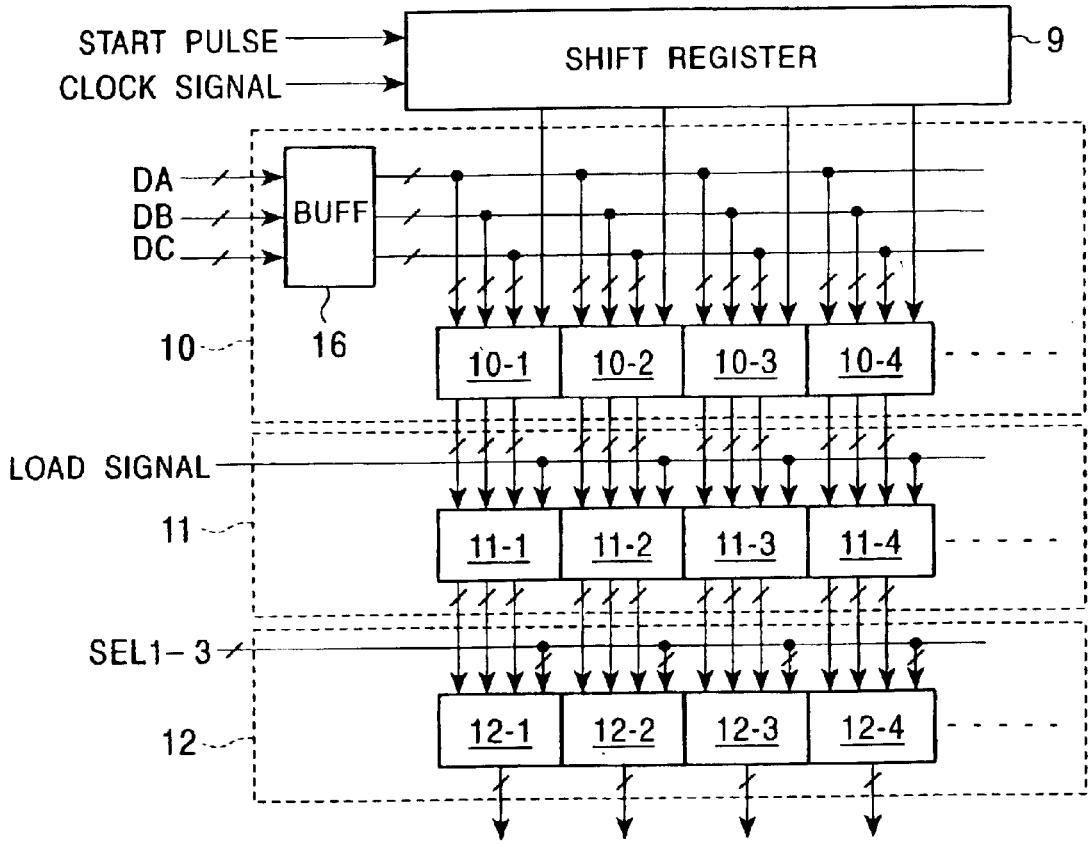
FIG. 7 shows the configuration of a sampling register, a line latch, and a selector in accordance with one embodiment of the present invention.

FIG. 7 shows the configuration of the sampling register 10, the line latch 11 and the selector 12 illustrated in FIG. 6. The sampling register 10 comprises a buffer 16, and stages 10-1, 10-2, 10-3, 10-4, and so forth. The image data DA, DB, and DC received by the sampling register 10 is supplied to each of the stages 10-1, 10-2, 10-3, 10-4, and so forth via the buffer 16. When the shift register 9 outputs "1" (i.e., an active signal), the corresponding stage (i.e., one of stages 10-1, 10-2, 10-3, 10-4, and so forth) stores the image data DA, DB, and DC received from the buffer 16. During a next cycle, the shift register propagates the "1" to the next output of the shift register in sequence and another corresponding stage (i.e., one of stages 10-1, 10-2, 10-3, 10-4, and so forth) stores the image data now supplied by the buffer 16.

In other words, when the start pulse is received by the shift register 9, the shift register 9 outputs "1" sequentially to each of the stages 10-1, 10-2, 10-3, 10-4, and so forth in that order. Accordingly, the stage 10-1 stores image data DA, DB, and DC that is first input to the sampling register 10, and the stage 10-2 stores image data DA, DB, and DC that is input second in sequence to the sampling register 10. Then, the stages 10-3, 10-4, and so forth store the image data DA, DB, and DC received by the sampling register 10 in that order.

The line latch 11 includes the stages 11-1, 11-2, 11-3, 11-4, and so forth. Each of these stages receives at an input the image data DA, DB, and DC output from the stages 10-1, 10-2, 10-3, 10-4, and so forth of the sampling register 10. When the level of the load signal received becomes high, all of the stages 11-1, 11-2, 11-3, 11-4, and so forth latch the image data DA, DB, and DC output from the stages 10-1, 10-2, 10-3, 10-4, and so forth.

The selector 12 includes the stages 12-1, 12-2, 12-3, 12-4, and so forth. Each of these stages receives at inputs the image data DA, DB, and DC output from the stages 11-1, 11-2, 11-3, 11-4, and so forth of the line latch 11. Each of the stages 12-1, 12-2, 12-3, 12-4, and so forth selects one from the image data DA, DB, and DC output from the stages 11-1, 11-2, 11-3, 11-4, and so forth in accordance with the received select signals SEL1, SEL2, and SEL3, and transmits the selected image data to the level shifter 13 illustrated in FIG. 6.

Figures 8A, 8B:
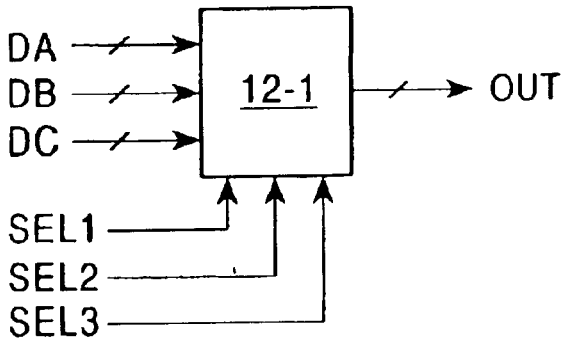
FIG. 8A shows the operation of stages of the selector in accordance with one embodiment of the present invention.
FIG. 8B further shows the operation of stages of the selector in accordance with one embodiment of the present invention.

FIGS. 8A and 8B illustrate the operation of the stages 12-1, 12-2, 12-3, 12-4, and so forth of the selector 12. FIG. 8A illustrates the stage 12-1, and FIG. 8B is a table describing the relationship between the select signals SEL1, SEL2, and SEL3 received by the stage 12-1, and a signal OUT output from the stage 12-1. As indicated by FIG. 8B, when the select signal SEL1 is "1", the image data DA is selected and output. When the select signal SEL2 is "1", the image data DB is selected and output. When the select signal SEL3 is "1", the image data DC is selected and output. Stages 12-2, 12-3, 12-4, and so forth operate in the same manner as in the case of the above-described stage 12-1, and will therefore not be described separately.

Figure 9:
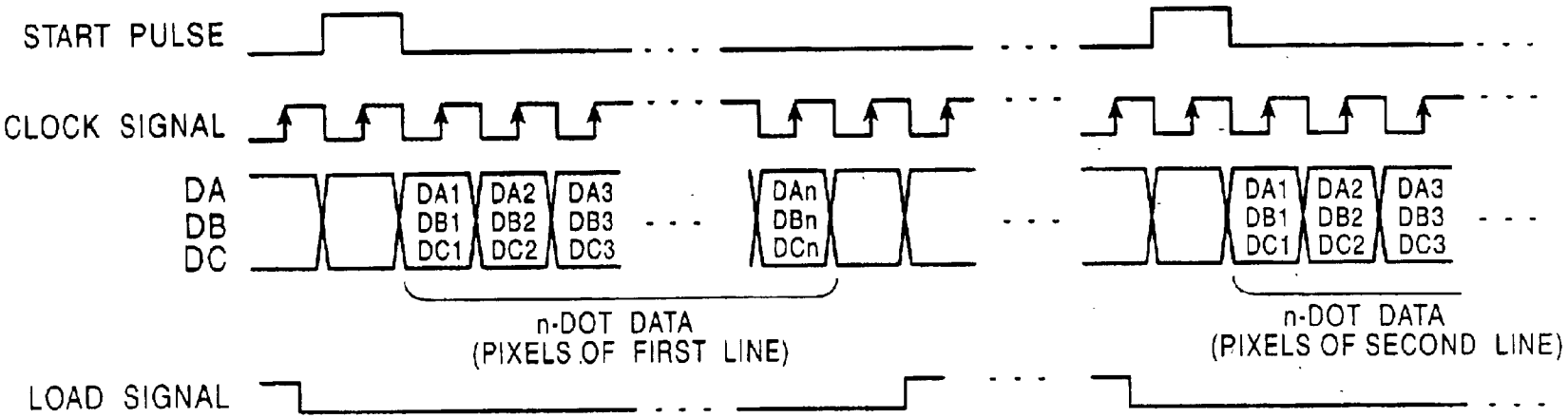
FIG. 9 is a timing chart of signals received by the source driver in accordance with one embodiment of the present invention.

FIG. 9 is a timing chart illustrating signals received at the inputs of source driver Sd. A start pulse is received at the source driver Sd concurrent with a clock signal supplied continuously. Then, the image data DA, DB, and DC is received by the source driver Sd in synchronization with the clock signals. For example, the image data DA, DB, and DC collectively corresponding to each image pixel to each After the image data DA, DB, and DC for the n subpixels is received by the source driver, a load signal is received by the source driver. In other words, the level of the load signal is set to high.

After the start pulse is received by the shift register 9 in conjunction with a continuous clock signal, the shift register 9 transmits a "1" to the stages 10-1, 10-2, 10-3, 10-4, and so forth in that order in synchronization with the clock signal. Then, the stages 10-1, 10-2, 10-3, 10-4, and so forth store the image data represented by the group DA, DB, and DC in the order in which the shift register 9 transmits "1" to the stages.

After the stages 10-1, 10-2, 10-3; 10-4, . . . , 10-n store the image data DA, DB, and DC for n subpixels, a common load signal is transmitted concurrently to each of the stages 11-1, 11-2, 11-3, 11-4, and so forth of the line latch 11. In other words, the level of the load signal is set to high. Then, each of the stages 11-1, 11-2, 11-3, 11-4, . . . , 11-n latches the image data DA, DB, and DC stored in the corresponding stages 10-1, 10-2, 10-3, 10-4, . . . , 10-n. Accordingly, the stages 11-1, 11-2, 11-3, 11-4, . . . , 11-n latch the image data DA, DB, and DC corresponding to one line of the display.

Figure 10:
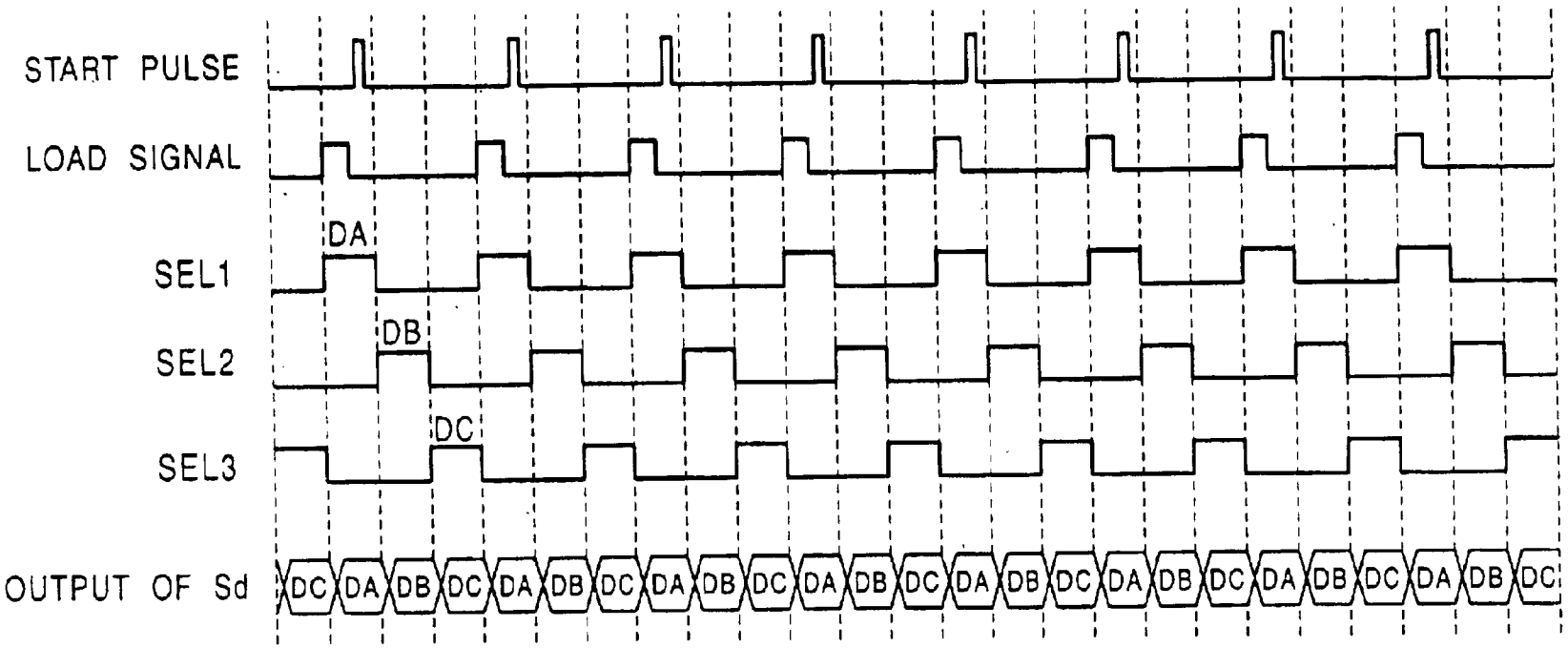
FIG. 10 is a timing chart illustrating signals received by and output from the source driver when triple-speed scanning (non-interlaced scanning) is performed in accordance with one embodiment of the present invention.

FIG. 10 is a timing chart showing signals received by and signals output from the source driver Sd when the triple-speed scanning (non-interlaced scanning) is performed. Initially, a load signal is received by the line latch 11 of the source driver Sd. A select signal SELL received by the selector 12 is "1", followed sequentially by a select signal SEL2 having a "1" value, and the select signal SEL3 having a "1" value. Then, the selector 12 outputs the image data in the order of DA, DB, DC, DA, DB, DC, and so forth onto the output lines of each stage. The source driver Sd outputs the image data along each signal line (i.e., S1, S2, S3, etc.)in the same order. Accordingly, lines having three sequences of subpixels, each of which forms a line of one pixel, are driven in order.

Figure 11:
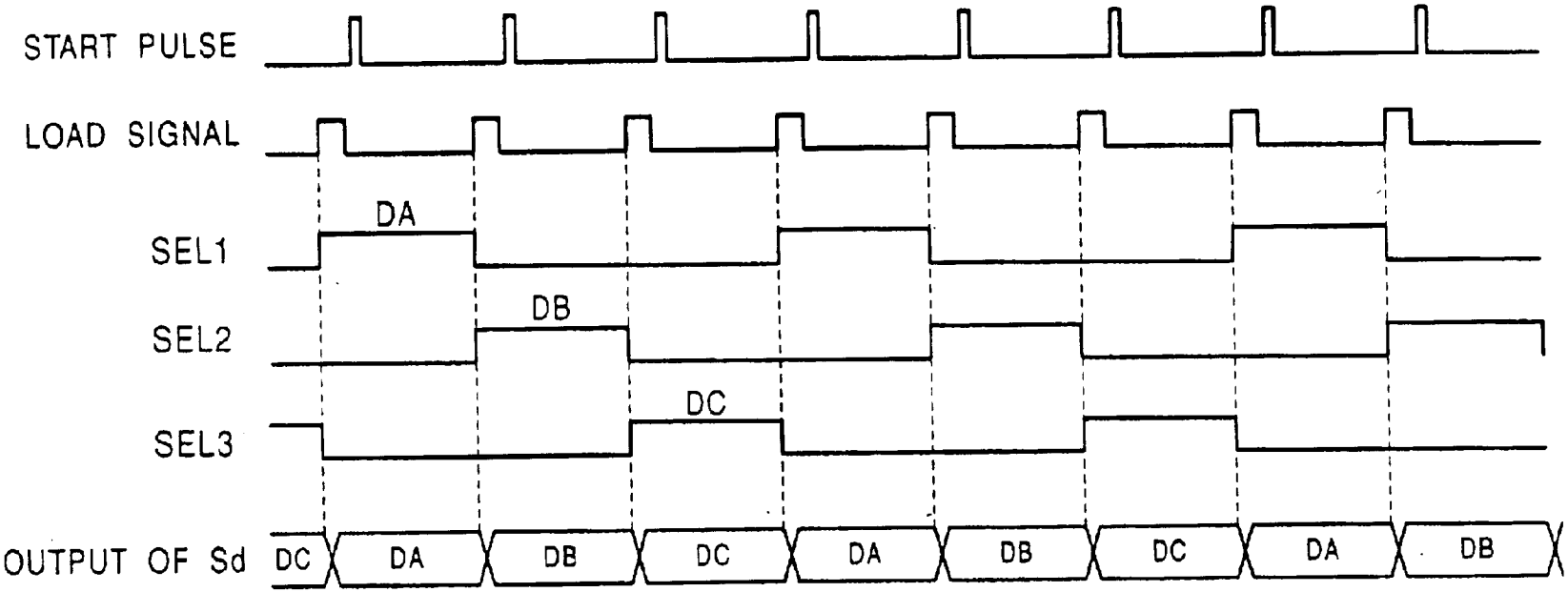
FIG. 11 is a timing chart illustrating signals received by and output from the source driver when thinning scanning (interlaced scanning) is performed in accordance with one embodiment of the present invention.
Figure 12:
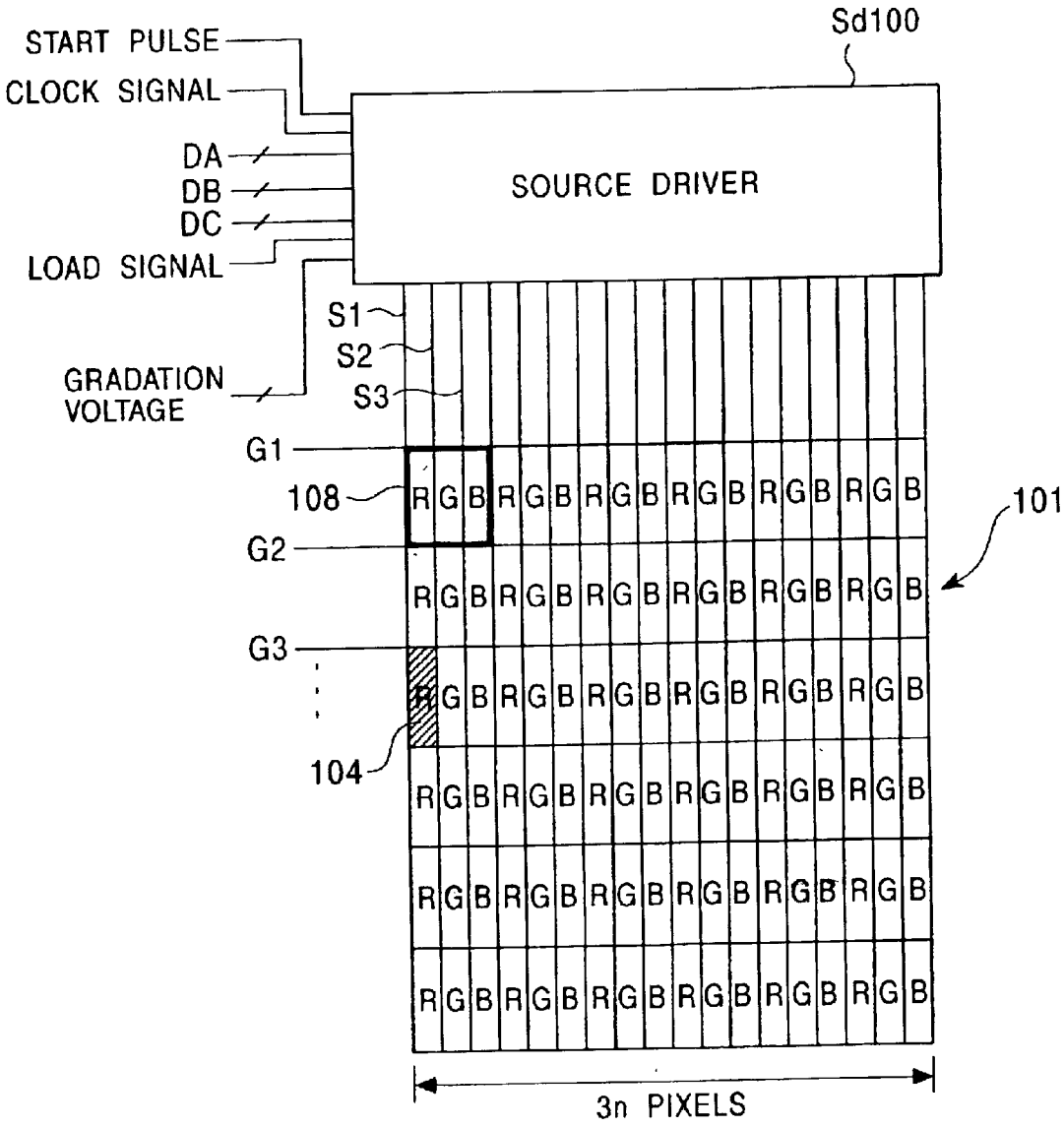
FIG. 12 PRIOR ART
FIG. 12 shows the arrangement of color filters each provided in each subpixel on a display of a conventional display device.
Figure 13:
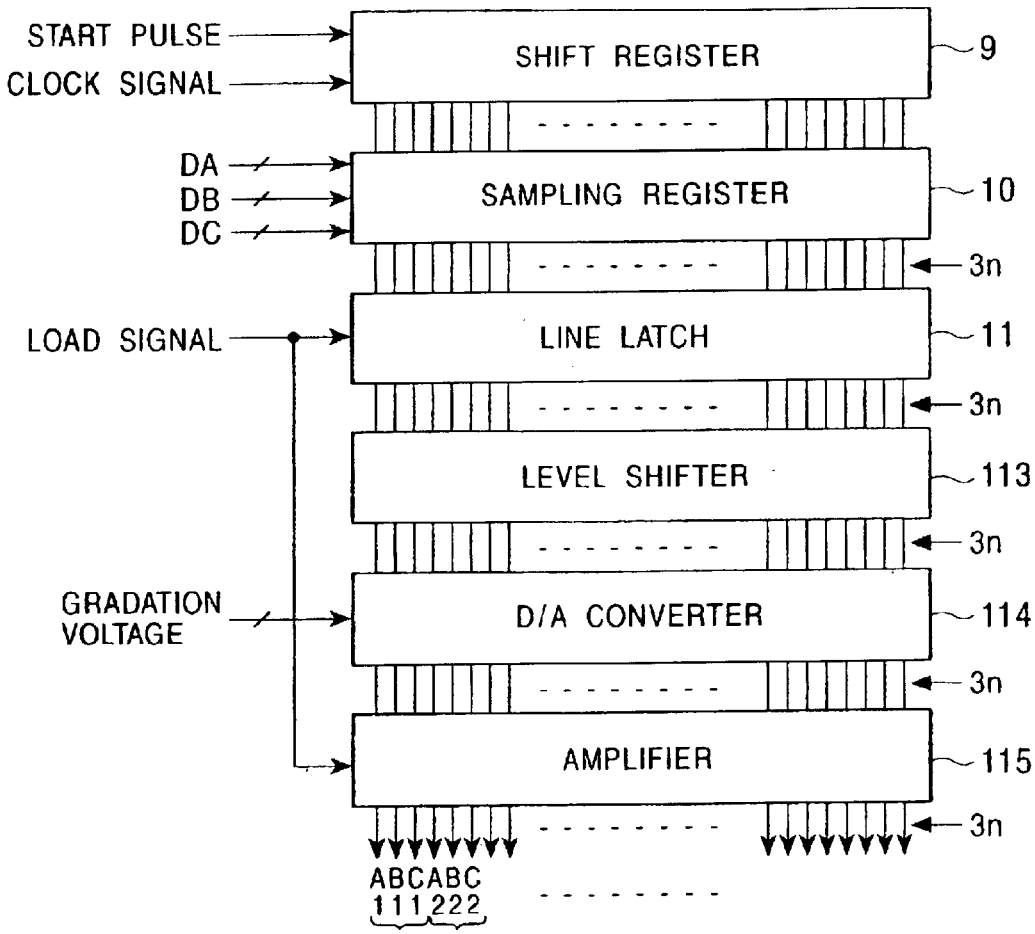
FIG. 13 PRIOR ART
FIG. 13 is a block diagram showing the configuration of a source driver in the conventional display device.
Figure 14:
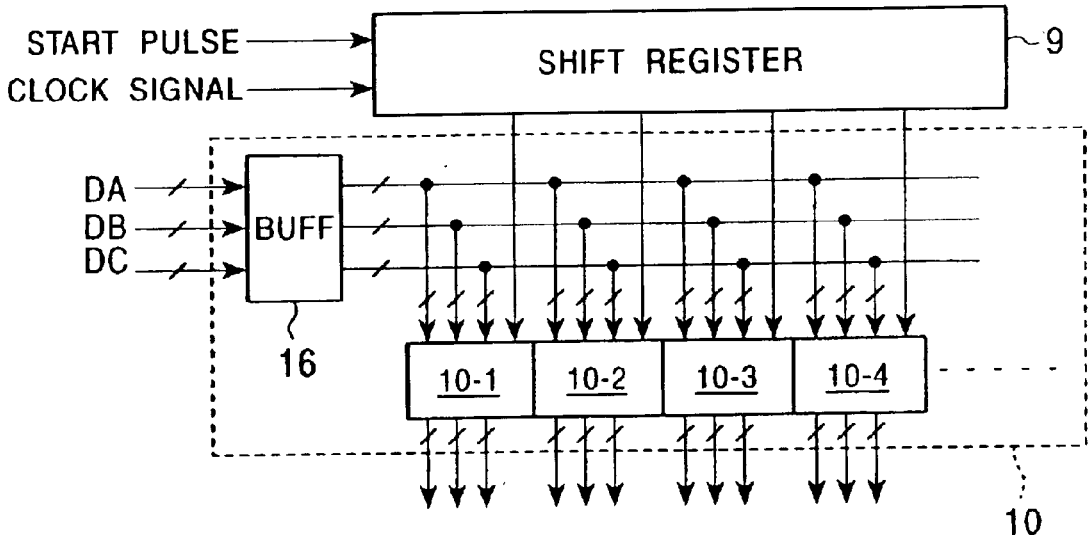
FIG. 14 PRIOR ART
FIG. 14 is a block diagram showing the configuration of a sampling register in the conventional source driver.

FIG. 11 is a timing chart showing a signal input and output by the source driver Sd when thinning scanning (interlaced scanning) is performed. Initially, a load signal is received by the line latch 11 of the source driver Sd and a select signal SEL1 received by the selector 12 is "1". Since the selector 12 outputs the image data DA, the source driver Sd also outputs DA.

When a next load signal is received, a select signal SEL2 received by the selector 12 is "1". Since the selector 12 outputs the image data DB, the source driver Sd also outputs DB.

When a next load signal is received, a select signal SEL3 received by the selector 12 is "1". Since the selector 12 outputs the image data DC, the source driver Sd also outputs DC. Accordingly, since the sequence or color of image data, output from the source driver Sd can be changed for every scan line, thinning scanning (interlaced scanning) is achieved. This illustrates that the display device may be configured to generate select signals so that subpixels for each scan line may be selected in any order desired and thus capable of driving a variety of configurations, for example including horizontal and vertical stripe, and a variety of scanning methods. In one embodiment, the select signals are generated in the external circuit (display control circuit) 2 by circuitry configured to provide the select signals in the proper sequence and timing.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims. Although the invention has been described as applicable for use in specific embodiments, including horizontal and vertical stripe display configurations, it is not intended to be so limited. The invention is intended to extend to use with all configurations of pixels and subpixels and scanning methods, including, for example, delta configurations.

What is claimed is:

1. An image signal driving circuit which inputs sequences of serial image data for a number of primary colors, converts the sequences of serial image data into parallel data for displaying one line on a display, and supplies the parallel data to the display, comprising:

a register that inputs the sequences of image data for the number of primary colors, stores the image data in order, arid outputs the image data as parallel data;

a latch that latches the sequences of image data for the number of primary colors output from the register; and a selector that selects one sequence from the sequences of image data for the number of primary colors latched by the latch in predetermined order, and supplies the selected image data to the display, wherein the selected image data is supplied to pixels corresponding to a single color selected from the primary colors, wherein the pixels corresponding to the single color correspond to a single gate wire, and wherein the serial image data corresponding to color filters in a vertical stripe configuration in which the primary colors are arranged in order in the direction of the gate wire is input, and the parallel image data corresponding to color filters in a horizontal stripe configuration in which the primary colors are arranged in order in the direction of a signal line is output.

2. An image signal driving circuit according to claim 1, wherein the selector selects one sequence from the sequences of image data in order corresponding to arrangement of the primary colors on the display, and supplies the selected sequence of image data to the display.

3. A display device comprising an image-signal driving circuit according to claim 1.

4. A display device according to claim 3, wherein the selector in the image-signal driving circuit selects one sequence from the sequences of image data in order corresponding to the arrangement of the primary colors on the display and supplies the selected sequence of image data to the display.

5. The display device as recited in claim 1 wherein the primary colors on the display are arranged in a horizontal stripe configuration.

6. The display device as recited in claim 5 wherein the primary colors on the display are arranged in a vertical stripe configuration.

7. The display device as recited in claim 5 wherein the predetermined order corresponds to a non-interlaced scan of lines on the display.

8. The display device as recited in claim 5 wherein the predetermined order corresponds to an interlaced scan of lines on the display.

9. The image signal driving circuit of claim 1, wherein the selector outputs the sequence of image data for n times the number of corresponding primary colors where the number of subpixels aligned in the horizontal direction is n.

10. The image signal driving circuit of claim 1, wherein color filters of the same color are disposed in the direction along a scanning line, and primary color filters are disposed in order in the direction along a signal line to form one pixel.

11. The image signal driving circuit of claim 1, wherein the number of the primary colors is three.

12. An image signal driving circuit for driving a display, the circuit comprising:

circuitry that receives sequences of serial image data corresponding to primary colors used for displaying a color and outputs parallel image data for displaying a line on a display; and a selector that selects one sequence of image data from the parallel image data output from the register according to a predetermined order and supplies the image data to a display, wherein the selected image data is supplied to pixels corresponding to a single color selected from the primary colors, wherein the pixels corresponding to the single color correspond to a single gate wire, and wherein the serial image data corresponding to color filters in a vertical stripe configuration in which the primary colors are arranged in order in the direction of the gate wire is input, and the parallel image data corresponding to color filters in a horizontal stripe configuration in which the primary colors are arranged in order in the direction of a signal line is output.

13. The image signal driving circuit as recited in claim 12 wherein the ratio of parallel image data output from the circuitry to the sequence of image data selected by the selector corresponds to the number of primary colors used in the display.

14. The image signal driving circuit as recited in claim 12 wherein the ratio of parallel image data output from the circuitry to the sequence of image data selected by the selector is about 3:1.

15. The image signal driving circuit as recited in claim 12 wherein the selector is configured such that the predetermined order corresponds to an arrangement of primary colors on the display is in accordance with a horizontal stripe configuration of the display.

16. The image signal driving circuit as recited in claim 12 wherein the selector is configured such that the predetermined order corresponds to an arrangement of primary colors on the display is in accordance with a vertical stripe configuration of the display.

17. The image signal driving circuit as recited in claim 12 wherein the selector is configured such that the predetermined order corresponds to a non-interlaced scan of lines on the display.

18. The image signal driving circuit as recited in claim 12 wherein the selector is configured such that the predetermined order corresponds to an interlaced scan of lines on the display.

19. The image signal driving circuit of claim 12, wherein the selector outputs the sequence of image data for n times the number of corresponding primary colors where the number of subpixels aligned in the horizontal direction is n.

20. The image signal driving circuit of claim 12, wherein color filters of the same color are disposed in the direction along a scanning line, and primary color filters are disposed in order in the direction along a signal line to form one pixel.

21. The image signal driving circuit of claim 12, wherein the number of the primary colors is three.

* * * * *